United States Patent [19]

Demoulin

[11] Patent Number: 4,660,892

[45] Date of Patent: Apr. 28, 1987

[54] SECTORIAL SPRINKLING DEVICE FOR COAL MINING

[75] Inventor: Jean J. Demoulin, Ippling, France

[73] Assignee: Charbonnages de France, Paris, France

[21] Appl. No.: 799,862

[22] Filed: Nov. 20, 1985

[30] Foreign Application Priority Data

Nov. 20, 1984 [FR] France ..... 84 17654

[51] Int. Cl.[4] ..... E21C 35/22; E21F 5/02

[52] U.S. Cl. ..... 299/81; 299/42

[58] Field of Search ..... 299/81, 17, 42

[56] References Cited

U.S. PATENT DOCUMENTS 3,843,199 10/1974 Nash et al. ..... 299/81
4,154,482 5/1979 Farman ..... 299/81
4,212,497 7/1980 Borowski et al. ..... 299/81 X
4,516,807 5/1985 Eagles ..... 299/81
4,565,410 1/1986 Hotger ..... 299/81

*Primary Examiner*—Stephen J. Novosad
*Assistant Examiner*—Michael A. Goodwin
*Attorney, Agent, or Firm*—Cushman, Darby & Cushman

[57] ABSTRACT

A sectorial sprinkling device for coal mining includes, in the central portion of a cutting drum of a cutting machine, a plurality of concentric piping systems which are connected to water delivery means. An interior piping system is permanently connected to the picks of the shearing disc of the drum, but the other two piping systems open via radial ducts into sectorial chambers whose angular extent corresponds to that of the active sectors of the lateral face of the cutting drum, depending on whether the cutting drum is in the high or low cutting position.

6 Claims, 7 Drawing Figures

SECTORIAL SPRINKLING DEVICE FOR COAL MINING

BACKGROUND TO THE INVENTION

The present invention relates to a sectorial sprinkling device which can be used for coal mining with a view to reducing the production of dust and to cooling tools in order to minimise the risk of explosion in atmospheres containing fire-damp.

Coal is mined, in particular, with the aid of integral cutting machines which are provided with one or more mobile arms each bearing a drum equipped with picks, the axis of the arms being perpendicular to the coal face which is being worked. The picks are placed both on the cylindrical surface of the drum and on that plane end surface of the drum which is opposite the worked coal face, that plane end surface often being referred to as a shearing disc. During cutting, the picks of the shearing disc continuously attack the mass of coal, whereas only some of the picks of the cylindrical surface are in contact with the coal at any given moment. Relative to the cutting machine, the position of these picks corresponds to a cylindrical sector of the drum. In general, the cutting arm is capable of occupying either a high position (roof mining) or a low position (floor mining). A cylindrical sector of the drum corresponds to each of these positions, for the picks which are in contact with the coal at any given moment, and these two sectors generally overlap to some extent.

The cutting machines often possess two cutting arms, one of which is situated at the front of the machine and is in the high position while the other of which is situated at the rear and is in the low position. When the cutting machine reaches the end of the cut, the position of the arms is reversed before the direction of movement of the machine is changed.

It is known to project water onto the mass of coal to be mined, in the vicinity of each pick. Picks exist which are specifically designed for this purpose, possessing a water-spraying nozzle at an appropriate point.

It is desirable to reduce the consumption of water which is used to the strictly minimum amount which is necessary, and thus at any given moment to supply only those picks which are in contact with the coal, namely on the one hand the picks of the shearing disc and on the other hand the picks of the cylindrical sector which are in contact with the mass of coal at that particular moment.

It is an object of the invention to provide a device for distributing spinkler water which is installed in the central part of a mining drum and comprises three feed circuits which permit the permanent feeding of the picks of the shearing disc and the selective feeding of the picks of two lateral cylindrical sectors, depending on the direction of horizontal movement of the drum.

SUMMARY OF THE INVENTION

The present invention provides a sectorial sprinkling device for the picks of a cutting drum in a cutting machine, the cutting drum having an end face which is provided with picks and a cylindrical surface which is provided with picks, the drum having two cylindical sectors each of which is active during the cutting operation when the drum is moved in a respective one of two opposed directions, the device comprising in a central zone of the drum, three concentric piping systems each of which is connected at one end thereof to at least one respective water delivery pipe, one of the concentric piping systems leading to a pipe which leads to the picks of the end face and the other two of the concentric piping systems each leading to a respective fixed part-annular sectorial chamber, each sectorial chamber being associated with respective ducts which can move in rotation, and are distributed circumferentially around, the respective sectorial chamber and are joined to the picks of the cylindrical lateral surface of the cutting drum, the sectorial chambers having relative positions and circumferential extents corresponding to those of the said cylindrical sectors of the drum.

In accordance with the invention, a cutting drum having an end face which is equipped with picks, called a shearing disc, and a cylindrical surface which is equipped with picks in which two opposing cylindrical sectors are distinguished. The two cylindical sectors have two diametrically opposed parts and may have a common part. The drum also has a central zone by means of which it is mounted on a fixed shaft which has at least one free end face. In accordance with the invention, three piping systems are provided in the shaft and in the central zone of the drum, these piping systems being concentric with the shaft and with the drum. The piping systems include a first interior cylindrical piping system, a second intermediate annular piping system and a third exterior annular piping system, which are each connected by one of their ends to a water delivery means comprising a stop valve. The piping systems each individually end either at ducts leading to the picks of the shearing disc, or at appropriate annular sectorial chambers provided on the shaft. Ducts corresponding to these chambers are distributed circumferentially over the drum and each are connected to a corresponding pick, for example by a flexible pipe.

Preferably, the first interior cylindrical piping system ends at the picks of the shearing disc.

Preferably, likewise, the second intermediate piping system is longer by its extreme end portion than the third exterior piping system, and several radial ducts connect these piping systems to the corresponding annular sectorial chambers which are located in axially spaced transverse planes.

On a cutting arm, the space available in the axial direction is extremely limited. Accordingly, advantageously, according to the invention, the piping systems provided in the shaft terminate, at their ends remote from the shearing disc of the drum, in the vicinity of a fixed transverse disc in which radial feed ducts are cut in a single plane which is perpendicular to the axis of the drum. The feed ducts are connected by their outer ends to water delivery pipes and their inner ends are extended by internal passages to the ends of the piping systems. In this manner, with little bulk in the axial direction, any one of the piping systems can be fed by several water delivery pipes and several internal passages, depending on the sprinkling flow required.

DESCRIPTION OF THE PREFERRED EMBODIMENTS

Figure 1:
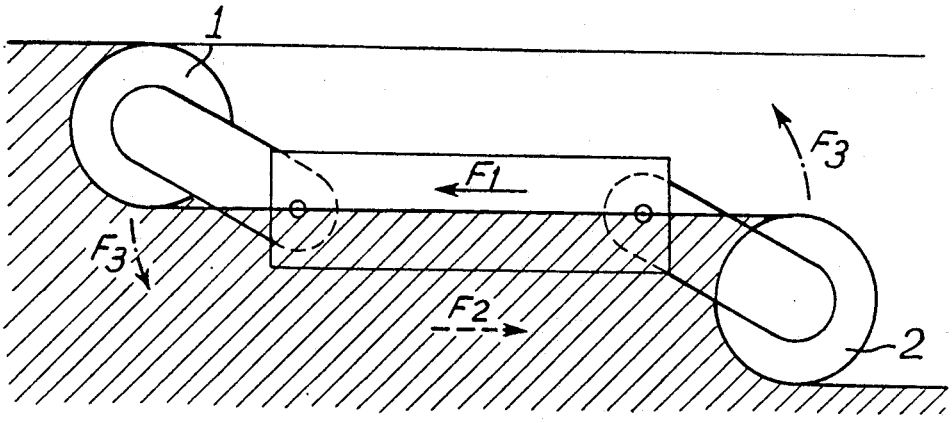
FIG. 1 is a diagrammatic representation of the position of two cutting drums on a cutting arm, showing why the sectorial feed of the picks is required.

FIG. 1 shows diagramatically a first cutting drum 1 and a second cutting drum 2 which are provided on a cutting machine which is moving in a horizontal direction from right to left in FIG. 1, as is indicated by an arrow F1. The first drum 1 is in the high position and the second drum 2 is in the low position. After travelling in the direction F1, the cutting machine moves in the opposite direction F2 after swinging of the drums 1, 2, as shown by arrows F3, in a manner such that the first drum 1 adopts the low position and the second drum 2 adopts the high position. Thus the leading drum is in the high position and the trailing drum is in the lower position.

Figure 2:
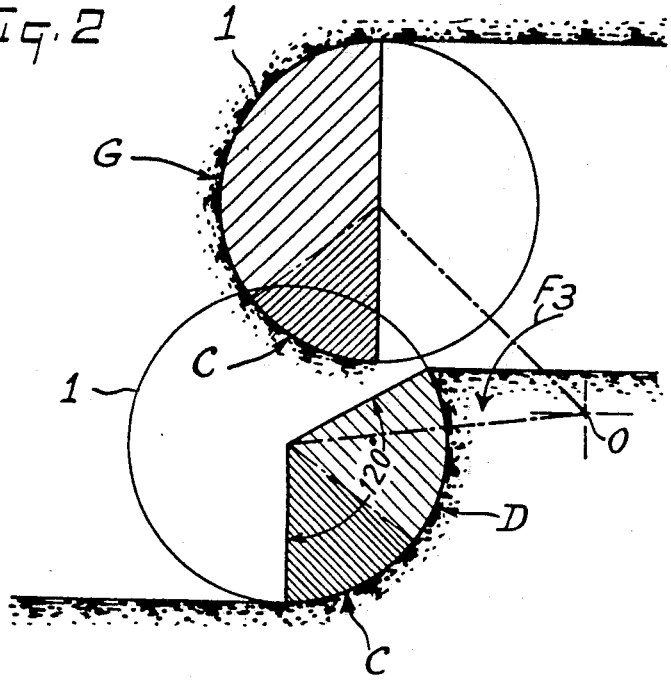
FIG. 2 is a diagrammatic representation of a cutting drum in the high position and in the low position, showing the sectors used.

FIG. 2 shows more clearly the change in the active sectors of the drums by which the coal is attacked during the cutting process, which results from the change between high and low positions of the drum 1 following its swinging in the direction F3, about a centre 0. In the high position, the entire left-hand cylindrical sector G of the lateral surface of the drum 1 is active over 180°. In the low position, the right-hand cylindrical sector D is active over 120°. As a result of the swinging, the two sectors G and D have a common portion C, indicated by dense shading, which is always active.

The picks of the common portion C of the sectors G and D require to be sprinkled continuously, while those of the remainder of the left-hand cylindrical sector G and those of the remainder of the right-hand cylindrical sector D require to be sprinkled only when the cutting drum is in the high or low position respectively. The sectorial sprinkling device according to the invention produces this result. Moreover, it provides a continuous feed of water to the picks of the shearing disc which attack the coal in both positions of the drum 1.

Figure 5:
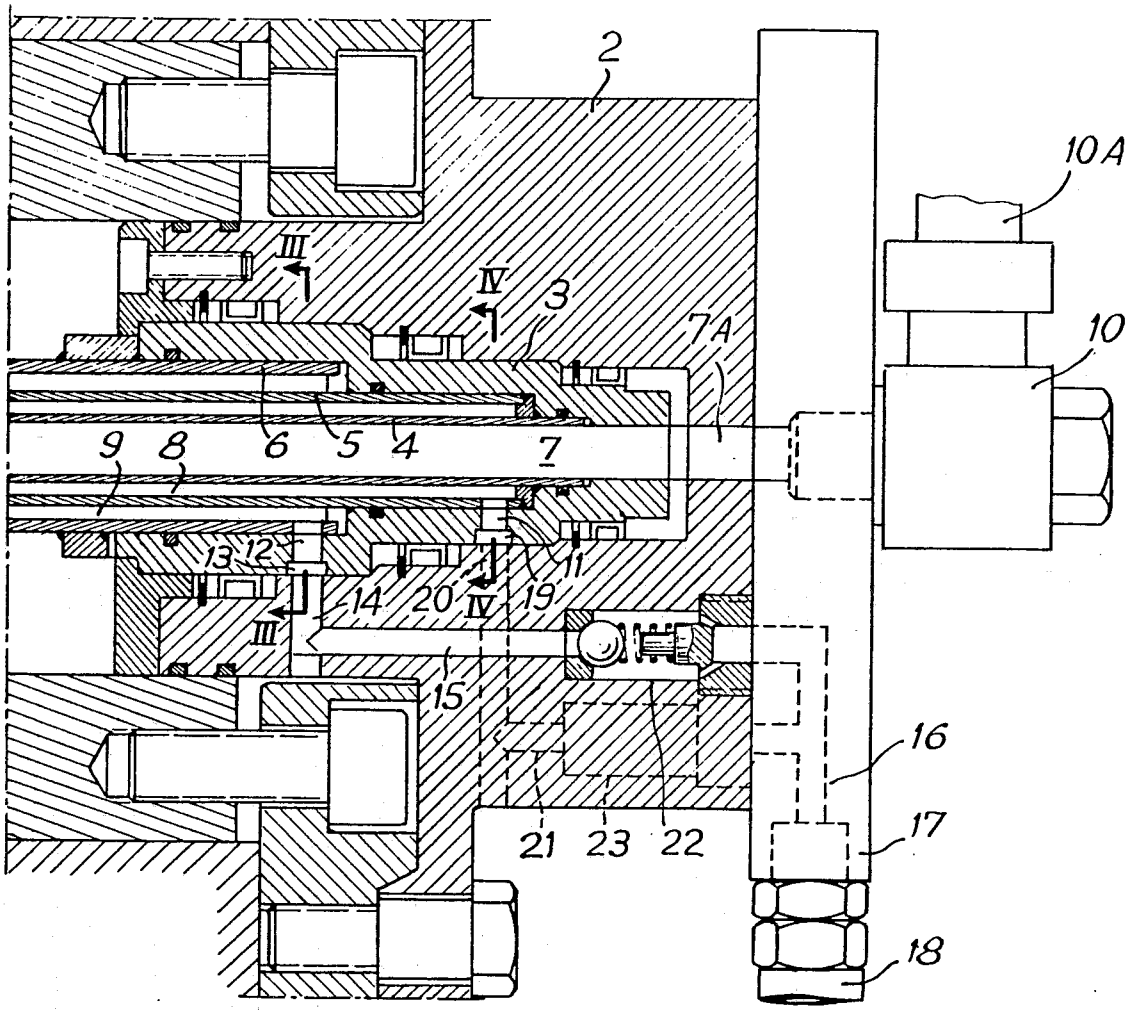
FIG. 5 is a partial view in longitudinal section on a plane passing through the axis of the fixed shaft which bears a cutting drum.

Since a cutting drum 1 is well-known to those skilled in the art, and since the invention does not relate to such a drum as a whole, it will not be described in detail. The drum 1 has a central portion 2 which is mounted to rotate about a shaft 3 which is fixed against rotation (FIG. 5). The shaft 3 is hollow and is pierced by longitudinal holes having staggered diameters and containing three pipes 4, 5, 6 which are mutually concentric and also concentric with the axis of the shaft 3, thereby forming a first interior cylindrical piping system 7, a second intermediate annular piping system 8 and a third exterior annular piping system 9, which are likewise concentric.

At the end part of the shaft 3 which is close to the drum, as shown in FIG. 5, the first interior cylindrical piping system 7 is extended by a duct 7A to a central connecting mouthpiece 10 from which run flexible pipes 10A which end at the picks of the shearing disc.

Figure 3:
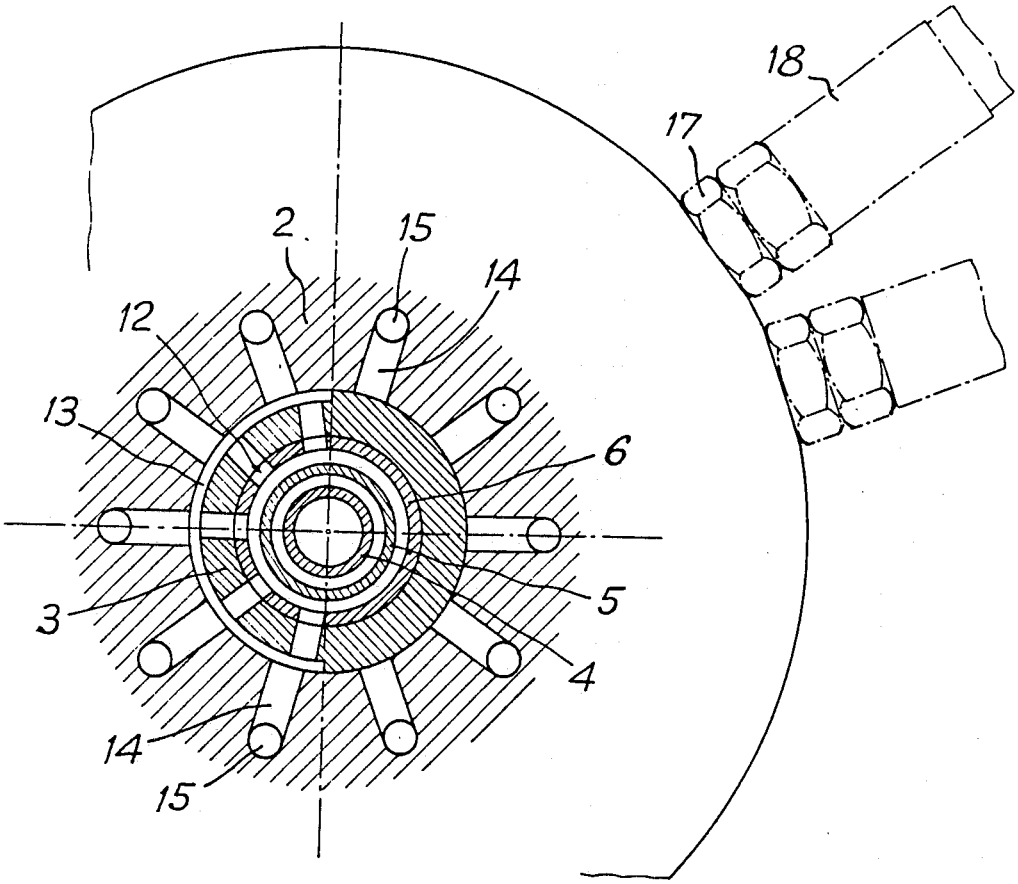
FIG. 3 is a partial view in section along the line III—III in FIG. 5.

The second intermediate piping system 8 and the third exterior piping system 9 finish in end portions located in transverse planes IV—IV and III—III respectively, these planes being spaced in the axial direction of the shaft 3, and a plurality of radial ducts 11, 12 respectively are provided therein. In the plane III—III which is shown in FIG. 3, the radial ducts 12 end, within the thickness of the shaft 3, in a part-annular sectorial chamber 13, contained within plane III—III, which is cut into the outer circumferential surface of the shaft 3, and extends over 180°. Still within the plane III—III, second radial ducts 14 are provided in the central portion 2 of the drum which extend radially away from the outer circumferential surface of the shaft 3. The number of the second radial ducts 14 corresponds to the number of picks on the lateral face of the drum 1 and the second radial ducts 14 are regularly spaced in the circumferential direction. The second radial ducts 14 are each extended within the drum 1 by axially extending longitudinal ducts 15 then by radial end ducts 16 (FIG. 5) ending in connecting mouthpieces 17 to each of which an end of a respective flexible pipe 18 is connected. Each of the flexible pipes 18 extends to a respective one of the picks of the lateral surface of the drum.

Figure 4:
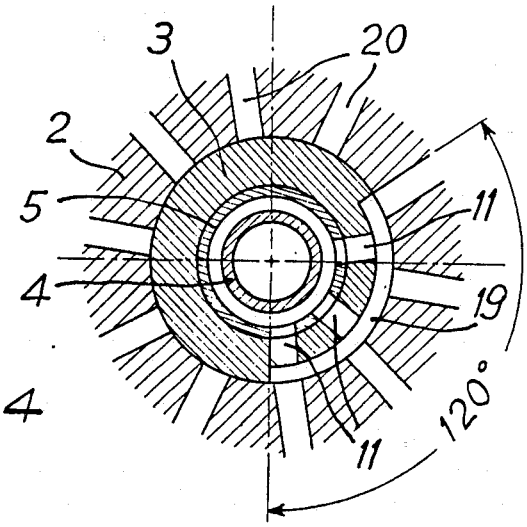
FIG. 4 is a partial view in section along the line IV—IV in FIG. 5.

As is shown in FIG. 4, in the plane IV—IV a similar arrangement exists to that which has just been described in relation to plane III—III. The radial ducts 11 end in a part-annular sectorial chamber 19 cut in the outer circumferential surface of the shaft 3, which extends only over an arc of 120°. In the central portion of the drum 1, second radial ducts 20 followed by axially extending longitudinal ducts 21 are joined to connecting mouthpieces 17 which are connected to flexible pipes 18 which lead to the picks.

The two part-annular sectorial chambers 13 and 19 are arranged, in the circumferential direction, to correspond with the active sectors G and D of the drum 1 (FIG. 1), and overlap in conformity with the common portion C. During the rotation of the drum 1, the picks which are connected to the second radial ducts 14 and 20 are fed with water only when the second radial ducts 14, 20 pass, during rotation, in line with the sectorial chambers 13 and 19. The sectorial chambers 13 and 19 are fed with water by the third exterior annular piping system 9 or by the second intermediate annular piping system 8, depending on whether the drum 1 is in the high or low position. Non-return valves 22, 23 are provided on the longitudinal ducts 15, 21 (FIG. 5) to prevent the water which is sent through one circuit from flowing back by the other circuit.

Figure 6:
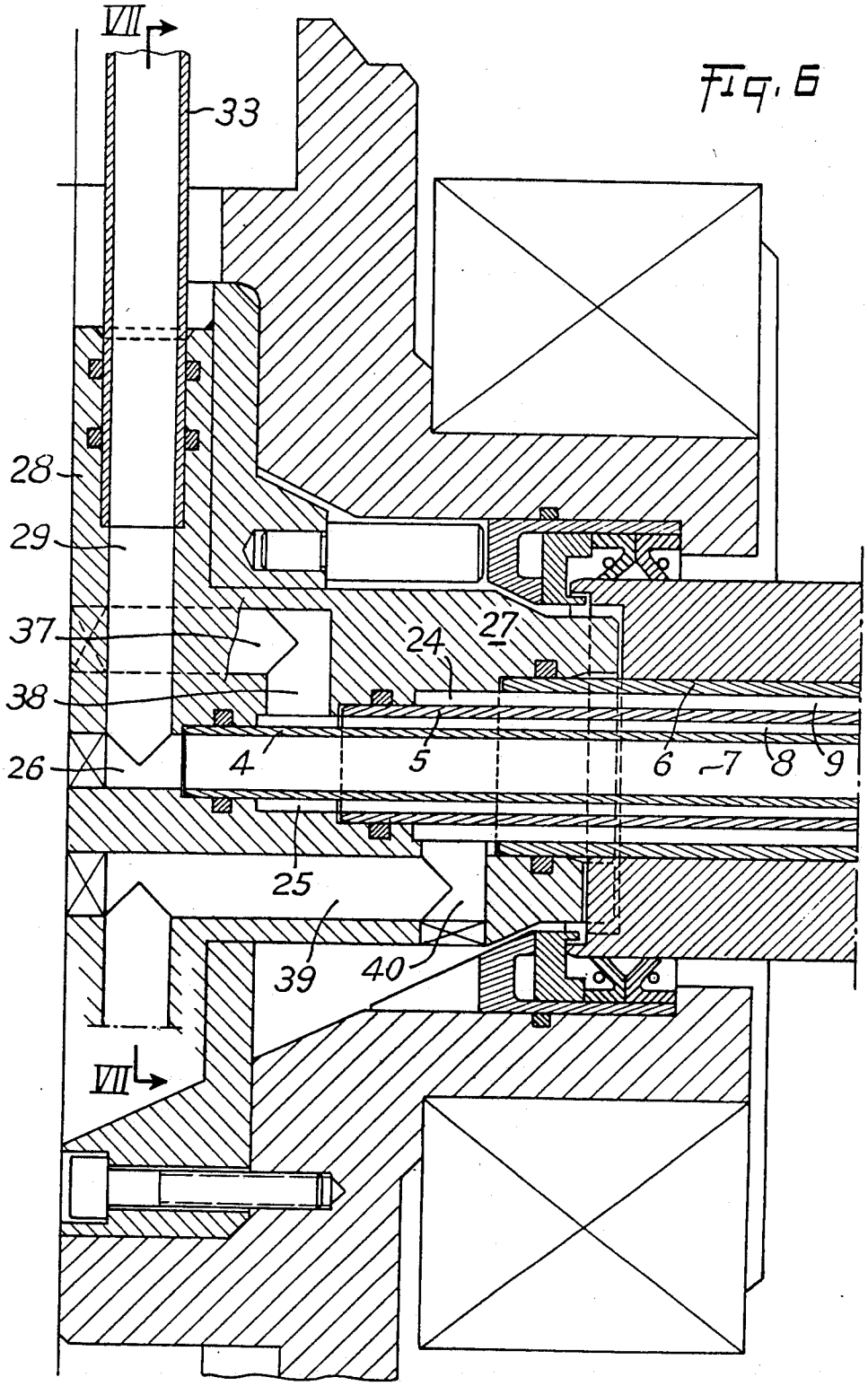
FIG. 6 is a view in longitudinal section as in FIG. 5 of the end portion of the shaft remote from the shearing disc of the cutting drum.
Figure 7:
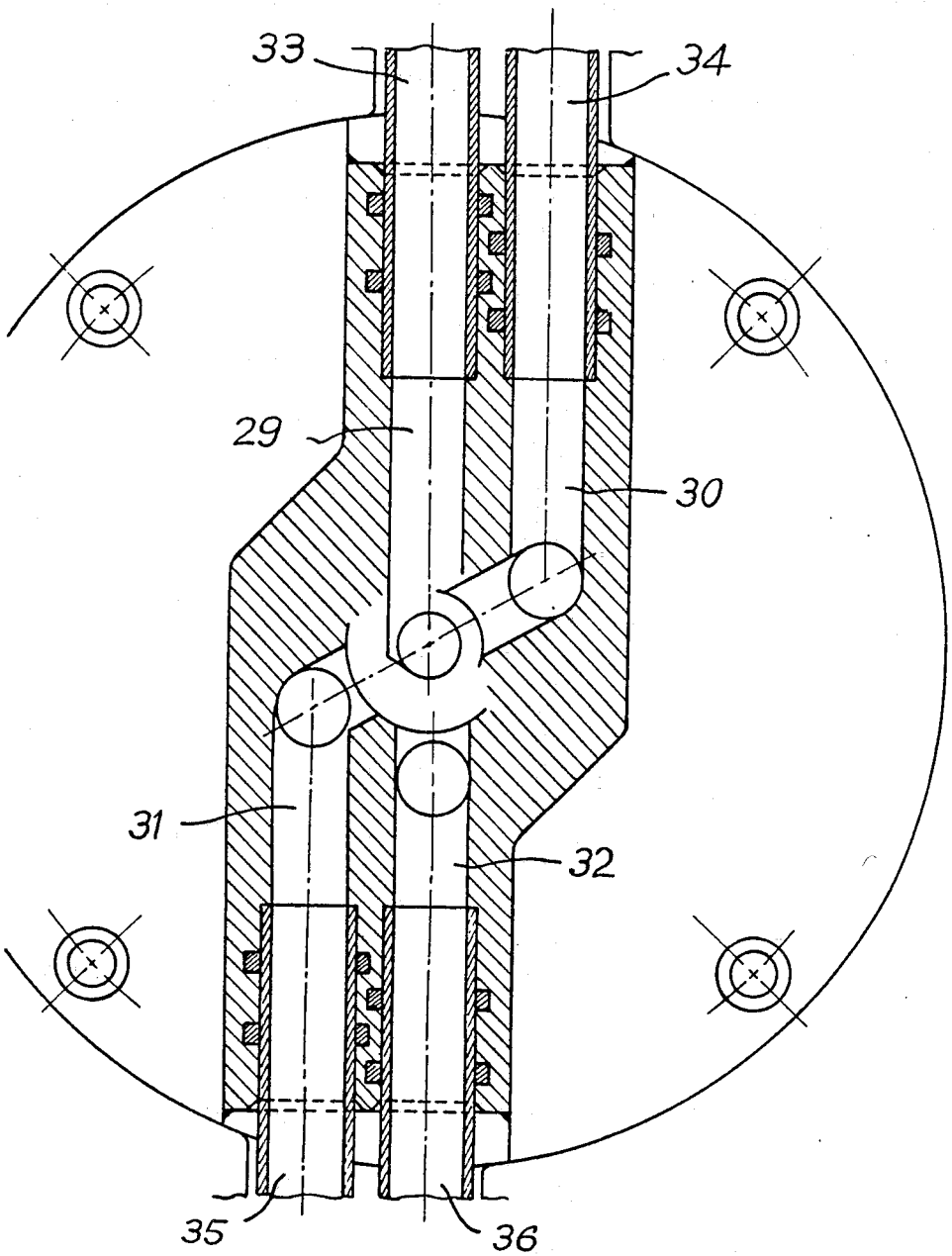
FIG. 7 is a view in section along the line VII—VII in FIG. 6.

The concentric piping systems 7, 8, 9 are fed with water continuously as regards system 7 and in an alternating manner as regards systems 8, 9 at that end of the shaft 3 which is remote from the shearing disc of the drum, preferably in the manner which will now be described with reference to FIGS. 6 and 7.

On the other side where the feed water arrives, the pipes 4, 5, 6 and hence the concentric piping systems 7, 8, 9 end in axially spaced planes, and each piping system terminates in a respective feed space 24, 25, 26 which is located in the extension of the respective system. The feed spaces 24, 25, 26 and the end portions of the pipes 4, 5, 6 are located in a fixed part 27 ending in a disc 28 which is arranged in a plane transverse to the axis of the cutting drum. The disc 28 is just sufficiently thick to enable radial feed ducts 29, 30, 31, 32 to be cut therein. The radial feed ducts 29, 30, 31, 32 are thus spaced in the circumferential direction and at their outer ends they are connected to respective water delivery pipes 33, 34, 35, 36. The radial feed duct 29 opens directly into the feed space 26 of the first interior cylindrical piping system 7. The radial feed duct 30 is connected by internal passages (a longitudinal passage 37 then a radial passage 38 cut in the fixed part 27) to the feed space 25 of the second intermediate annular piping system 8. The two feed ducts 31, 32 each open into the feed space 24 of the third exterior annular piping system 9 by way of a respective longitudinal internal passage 39 and a respective radial internal passage 40. Using a thin disc 28, which hence has little bulk in the axial direction, it is possible to feed each of the concentric piping systems 7, 8, 9 by means of several water delivery pipes 33 to 36 if the flow makes this necessary. Stop valves (not shown) are mounted on the water delivery pipes 34 and 35, 36 and are opened or closed, automatically, as a function of the high or low position which is taken up by the cutting drum.

The circumferential extent of the sectorial chambers 13, 19 is selected to correspond with that of the respective active cylindrical sectors G, D of the cutting drum. The extent of the active sector G in the high position of the drum is generally 180°, although it may be desirable to carry out sprinkling over a wider extent which may reach about 210°. The angular extent of the active sector D in the low position of the drum varies according to the height of the working face; in practice it may be from 60° to 180°.

I claim:

1. A sectorial sprinkling device for the picks of a cutting drum in a cutting machine, the cutting drum having an end face which is provided with picks and a cylindrical surface which is provided with picks, the drum having two cylindrical sectors each of which is active during the cutting operation when the drum is moved at a high cutting position or a low cutting position in a respective one of two opposed directions, the device comprising in a central zone of the drum, three concentric piping systems each of which is connected at one end thereof to at least one respective water delivery pipe, one of the concentric piping systems leading to a pipe which leads to the picks of the end face and the other two of the concentric piping systems each leading to a respective fixed part-annular sectorial chamber, each sectorial chamber being associated with respective ducts which can move in rotation and are distributed circumferentially around the respective sectorial chamber and are joined to the picks of the cylindrical lateral surface of the cutting drum, the sectorial chambers having relative positions and circumferential extends corresponding to those of the said cylindrical sectors of the drum.

2. A sectorial sprinkling device according to claim 1, wherein the said one of the concentric piping systems is a first interior piping system which is cylindrical and is extended by a first duct to a central mouthpiece which provides a connection to the pipe which leads to the picks of the end face of the cutting drum.

3. A sectorial sprinkling device according to claim 2 wherein said other two concentric piping systems comprise an intermediate annular piping system and an exterior piping system with said intermediate annular piping system being longer at its extreme end portion than said exterior annular piping system, said device further comprising a plurality of respective radial ducts which connect said second and third piping systems to the respective corresponding sectorial chambers which are located in axially spaced transverse planes.

4. A sectorial sprinkling device according to claim 1, wherein the angular extent of that one of the sectorial chambers which corresponds to the cylindrical sector which is associated with a high cutting position of the cutting drum is from 180° to 210° and the angular extent of the other one of the sectorial chambers which corresponds to the cylindrical sector which is associated with a low cutting position of the cutting drum is from 60° to 180°.

5. A sectorial sprinkling device according to claim 1, wherein at their ends which are remote from the said end face of the cutting drum, the concentric piping systems end in the vicinity of a fixed transverse disc in which disc are cut, in a single plane which is perpendicular to the axis of the drum, a plurality of radial feed ducts having their outer ends being connectable to water delivery pipes and their inner ends being extended by respective internal passages to the said remote ends of the respective concentric piping systems.

6. A sectorial sprinkling device according to claim 5, wherein at least one of the concentric piping systems is connected by internal passages to two radial feed ducts which are provided in the transverse disc.

* * * * *